US006378977B1

(12) United States Patent
Gompertz

(10) Patent No.: US 6,378,977 B1
(45) Date of Patent: Apr. 30, 2002

(54) SYSTEM AND METHOD FOR CONVEYING PRINTER STATUS INFORMATION

(75) Inventor: Ronald S. Gompertz, Camas, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/608,910

(22) Filed: Jun. 30, 2000

(51) Int. Cl.[7] ..... B41J 29/393; B41J 29/38; B41J 29/18

(52) U.S. Cl. ..... 347/19; 347/14; 400/703

(58) Field of Search ..... 347/19, 14, 23, 347/5; 400/703, 320, 582

(56) References Cited

U.S. PATENT DOCUMENTS 5,842,800 A 12/1998 Bailey et al. ..... 347/19
5,856,833 A 1/1999 Elgee et al. ..... 347/19
6,146,037 A * 11/2000 Schuh et al. ..... 400/703

OTHER PUBLICATIONS

Co–pending, commonly assigned, U.S. Patent Application Ser. No. 09/379,705, filed Aug. 24, 1999, entitled "Method for Indicating Printer Status".
Hewlett–Packard Company, "HP DeskJet Printer User's Guide", Jul. 1999, pp. i–1.

* cited by examiner

*Primary Examiner*—John Barlow
*Assistant Examiner*—Charles W. Stewart, Jr.
(74) *Attorney, Agent, or Firm*—Charles F. Moore

(57) ABSTRACT

Systems and methods for conveying printer status information to a user are provided. One or more moving light sources are selectively illuminated to convey printer status information to the user and to attract the user's attention. Different illumination states correspond to different printer status and configuration information. The light source may be part of an optical sensor. In this manner, the light source may have dual functions: (1) to illuminate the print media during a calibration operation performed by the optical sensor; and (2) to selectively illuminate during a printing operation to convey printer status information to the user.

3 Claims, 4 Drawing Sheets

| CONDITION INDICATED | LED 60 | LED 62 | BLINKING |
|---|---|---|---|
| NORMAL PRINT QUALITY | ON | ON | NO |
| TWO-SIDED PRINTING | ON | ON | YES |
| DRAFT PRINT QUALITY | OFF | OFF | NO |
| BEST PRINT QUALITY | ON | OFF | NO |
| SPECIAL MEDIA | OFF | ON | NO |

| CONDITION INDICATED | LED 50 | BLINKING |
|---|---|---|
| NORMAL PRINT QUALITY | ON | NO |
| TWO-SIDED PRINTING | ON | YES |
| DRAFT PRINT QUALITY | OFF | NO |

| CONDITION INDICATED | LED 60 | LED 62 | BLINKING |
|---|---|---|---|
| NORMAL PRINT QUALITY | ON | ON | NO |
| TWO-SIDED PRINTING | ON | ON | YES |
| DRAFT PRINT QUALITY | OFF | OFF | NO |
| BEST PRINT QUALITY | ON | OFF | NO |
| SPECIAL MEDIA | OFF | ON | NO |

SYSTEM AND METHOD FOR CONVEYING PRINTER STATUS INFORMATION

TECHNICAL FIELD

The present invention relates generally to systems and methods for conveying printer status information to a user and, more particularly, to systems and methods for utilizing a moving light source to convey printer status information to a user.

BACKGROUND

Ease of use is an important quality for printing devices. In the consumer printer and home printing markets it is particularly important for a printer to be "user-friendly". In these markets customer satisfaction can be strongly influenced by a printer's ease of use, or lack thereof.

One aspect of a "user-friendly" printer is its effectiveness in communicating printer status and configuration information to the user. As printers offer increased functionality and expanded capabilities, it becomes increasingly more challenging to effectively convey printer status and configuration information to a user in a cost-effective manner.

A number of techniques and features are presently utilized to convey printer status information to a user. Many printers include one or more indicator lights on an outer portion or control panel of the printer. For example, the DeskJet® 970 color inkjet printer, produced by Hewlett-Packard Co. of Palo Alto, Calif., utilizes three LED (light emitting diode) indicators on a control panel. A Print Cartridge Status LED flashes to indicate that one or more print cartridges are low on ink, improperly installed or malfunctioning. A Resume LED flashes to prompt the user to press a resume button to continue printing. A Power LED indicates that the printer is on and flashes when the printer is processing information.

Some printers use software to generate messages to the user relating to printer status that are displayed on the user's monitor. However, these messages are often hidden under the application window currently in use and frequently go unseen.

Some more expensive printers, such as the Color LaserJet® 4500 printer produced by Hewlett-Packard Co. of Palo Alto, Calif., include an LCD (liquid crystal display) or other type of display mounted on the printer that generates messages to the user. However, these displays are costly and add manufacturing complexity to the product, making them ill-suited for a low-cost consumer printer.

Furthermore, despite the above-described communication features, for many users the information and feedback they receive from their printer is incomplete and often difficult to understand. A common user complaint is that the procedures for selecting print quality modes, media types and media handling options are confusing. This lack of understanding can lead to improper settings, unsatisfactory results and eventually customer frustration, especially when special print media is used and mistakes are costly. Additionally, printers typically provide little or no status information to the user during the actual printing operation, such as print quality mode, type of media being used, paper handling options selected, etc.

The DeskJet® 970 color inkjet printer referenced above also includes an optical emitter/sensor that is mounted to the reciprocating printhead carriage. The sensor includes a pair of Light Emitting Diode (LED) lamps that illuminate a selected region of a media sheet during a calibration operation. The light from the illuminated region is received by a photodetector in the sensor and analyzed to calculate printer adjustments and calibrations. The illumination of the LED's is carefully controlled during the calibration functions, and is either non-pulsed (continuous) or pulsed (blinking) at defined intervals. Where a pulsed (blinking) LED is utilized, the pulsing frequency of the LED may not be varied outside the calibration parameters during the calibration operation.

What is needed is an improved system and method for communicating printer status and configuration information to a user that addresses the drawbacks of the prior art.

SUMMARY OF THE INVENTION

The present invention overcomes or reduces the disadvantages of the prior art by providing systems and methods for conveying printer status information to a user. In one embodiment, a light source is moved and illuminated to convey printer status information to the user and to attract the users attention. One or more light sources may be illuminated continuously or in a blinking fashion during a printing operation to convey status information. Different illumination states correspond to different printer status and configuration information.

In another aspect of the present invention, the light source may be part of an optical sensor. In this manner, the light source may have dual functions: (1) to illuminate the print media during a calibration operation performed by the optical sensor; and (2) to selectively illuminate during a printing operation to convey printer status information to the user.

Other features and advantages of the present invention will become apparent to one with skill in the art upon examination of the following drawings and detailed description. It is intended that all such additional features and advantages be included herein within the scope of the present invention.

BRIEF DESCRIPTION OF THE SEVERAL VIEWS OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

Figure 1:
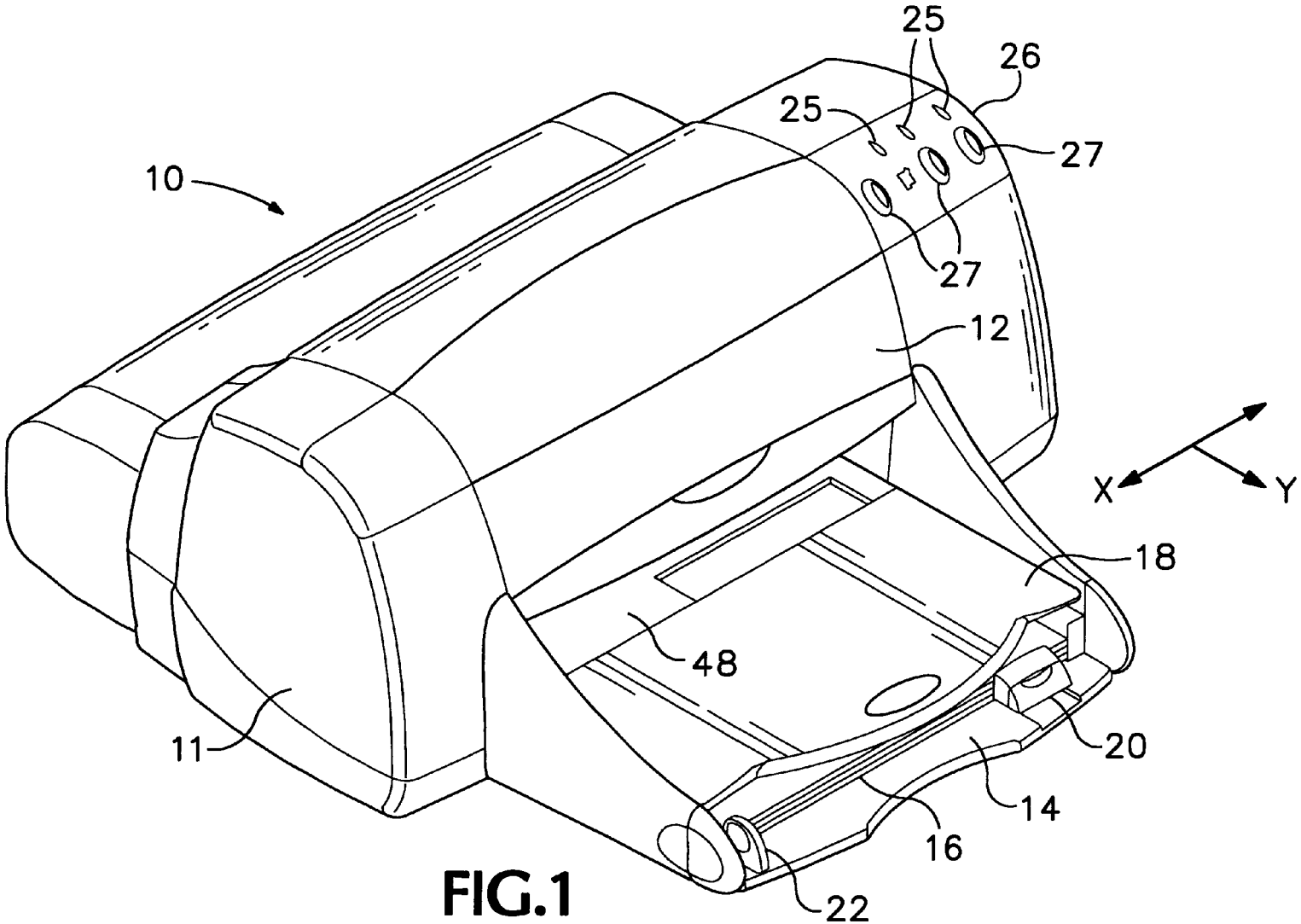
FIG. 1 is a perspective view of an inkjet printer that utilizes the systems and methods of the present invention.

FIG. 1 illustrates an embodiment of an inkjet printing apparatus 10 that utilizes the systems and methods of the present invention. A variety of inkjet printing apparatus are commercially available. For example, some of the printing apparatus that may utilize the systems and methods of the present invention include plotters, portable printing units, copiers, scanners and facsimile machines. To facilitate description, the concepts of the present invention are described in the environment of an inkjet printing apparatus 10 that may find particular usefulness in the home environment.

The inkjet printing apparatus 10 includes a housing 11 and a lid 12 shown in a closed position. A media tray 14 holds sheets of print media 16 that are fed into the printer 10 by a media transport system (not shown), as known to one of skill in the art. The print media may be any type of suitable sheet material, such as paper, card-stock, envelopes, fabric, transparencies, mylar and the like. For convenience, the illustrated embodiment is described with paper as the print media. The media tray 14 may include one or more adjustment mechanisms for accommodating different sizes of print media, such as a sliding length adjustment lever 20 and a sliding width adjustment lever 22. An output tray 18 receives sheets of printed media produced by the printer 10.

A control panel 26 on the printer 10 includes indicator lights 25 and associated buttons 27 for normal printer control functions such as power on/off, resume printing and cancel printing. The printer 10 includes a controller (not shown) that receives instructions from a host device such as a personal computer or the control panel 26. The controller includes logic that distributes control signals and generally controls the operation of the printer 10 and its various components and subsystems.

Figure 2:
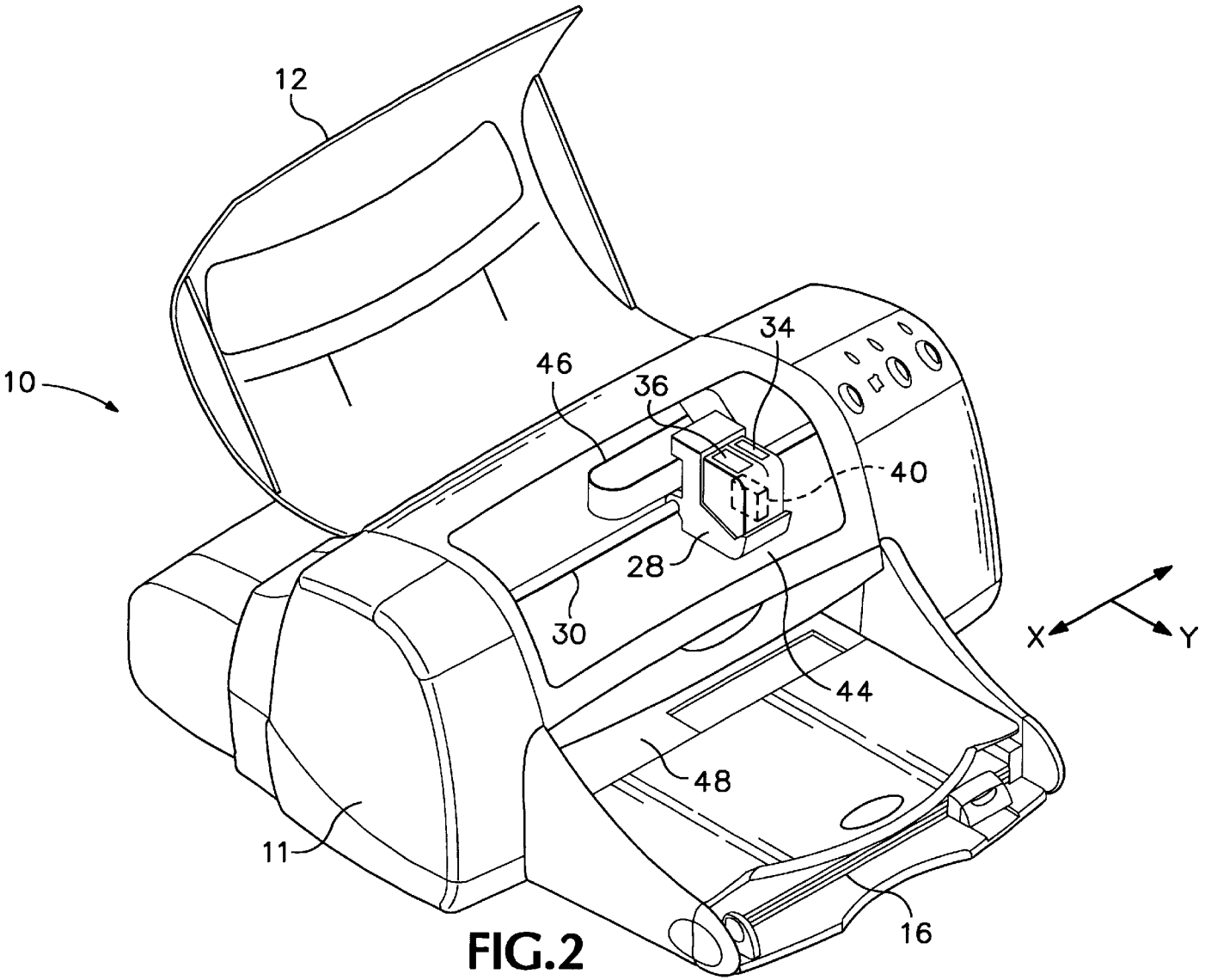
FIG. 2 is a perspective view of the inkjet printer of FIG. 1 with the top cover of the printer opened to reveal the printhead carriage.

FIG. 2 shows the printer 10 with the lid 12 in an open position to reveal a carriage 28. The carriage 28 is slidably mounted on a guide rod 30 for reciprocating motion over the print media. The carriage 28 holds a black inkjet pen 34 and a color inkjet pen 36. The color pen 36 may include three colors of ink, such as cyan, yellow and magenta. Both inkjet pens 34, 36 include a printhead having an array of orifices through which droplets of ink are expelled onto the surface of the media to generate an image. More specifically, the ink is expelled from one or both pens 34, 36 as the carriage 28 moves laterally over a print zone 44 in an x-axis direction. Between carriage scans the media is advanced in a y-axis direction that is perpendicular to the carriage scan x-axis direction. In this manner, an image may be generated in a raster fashion by building up the image line by line.

With continued reference to FIG. 2, an optical emitter/sensor module 40 is also mounted to the carriage 28. The sensor module 40, pens 34, 36 and carriage 28 are electrically connected to the printer 10 and controller by a flexible ribbon cable 46.

As is known in the art, the optical emitter/sensor module 40 may be utilized to perform various printer calibration operations, such as image registration and linefeed adjustments, and to determine media size and/or type. A typical emitter/sensor module includes one or more light sources, such as Light Emitting Diode (LED) lamps, a photodetector and a lens element. Typically, the emitter/sensor module is propelled back and forth across a media sheet as an LED illuminates a selected region of the sheet. The lens element focuses light from the illuminated region onto the photodetector. As the module scans across the sheet and over a printed pattern or edge of the sheet, the photodetector records variations in collected light flux. Printer electronics calculate the location of the printed pattern or sheet edge by coordinating with an electronic signal from a motion encoder that records the position of the module relative to the printer. A more detailed description of an optical emitter/sensor and its operation in an inkjet printer is provided in U.S. Pat. No. 5,856,833 assigned to the assignee of the present application, Hewlett-Packard Co. U.S. Pat. No. 5,856,833 is specifically incorporated by reference in pertinent part.

Figures 3, 4:
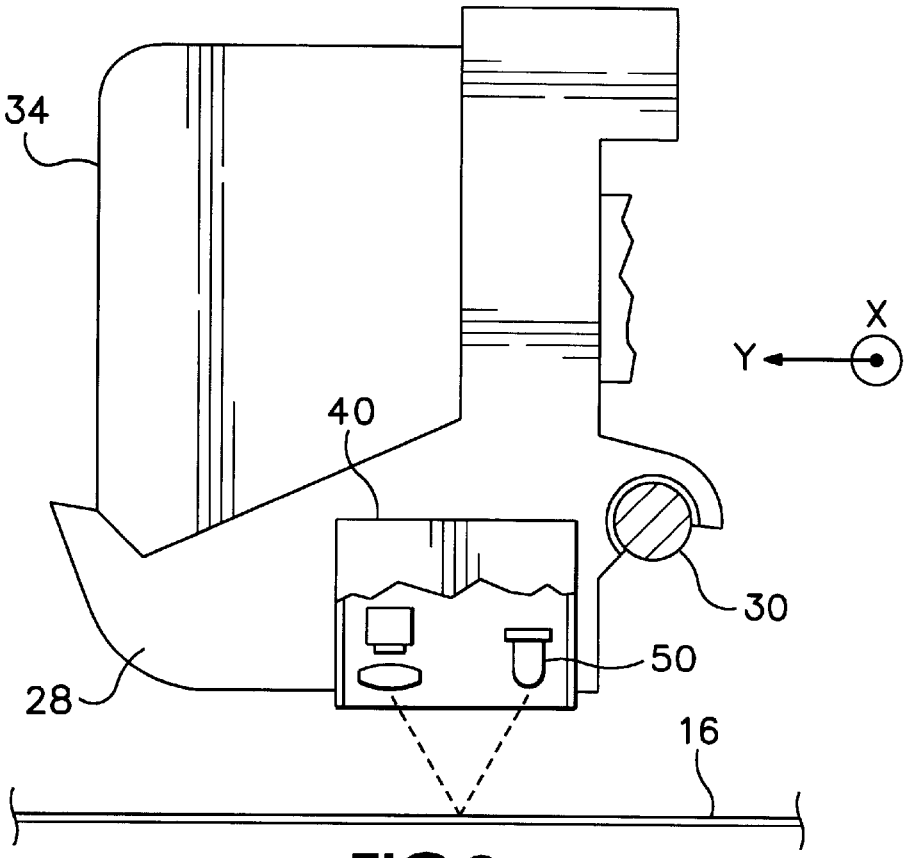
FIG. 3 is a schematic side view of the printhead carriage of the printer of FIG. 1 showing the emitter/sensor illuminating the media.
FIG. 4 is a table illustrating different illumination conditions and the corresponding printer status/configuration information as utilized in one embodiment of the present invention.

With reference now to FIG. 3, and in one embodiment of the present invention, the emitter/sensor module 40 may comprise a single LED 50 that illuminates the media sheet 16 as the carriage 28 reciprocates in an x-axis direction. In an important aspect of the present invention, the emitter/sensor module 40 may be controlled to convey printer status or configuration information to the user. More specifically, the LED 50 may be selectively illuminated while moving the carriage 28 to convey printer status or configuration information and to attract the attention of the user during a printing operation.

With reference to the printer 10 illustrated in FIGS. 1 and 2, during a printing operation the lid 17 is closed and the print zone 44 is substantially shielded from ambient light. In this manner, as the carriage 28 reciprocates over the darkened print zone 44, visible light from the LED 50 will emanate through the gap 48 between the lid 12 and the output tray 18. Advantageously, by selectively illuminating the LED 50 during a printing operation, valuable printer status information may be conveyed to the user.

The table of FIG. 4 illustrates one example of different illumination options and their corresponding printer status indications as contemplated by the present invention. Continuously illuminating the LED 50 indicates that a Normal Print Quality mode is being utilized. Pulsing or blinking the LED 50 indicates that two-sided printing is being utilized. And not illuminating the LED 50 during printing indicates that a Draft Print Quality mode is being utilized. It will be appreciated that these illumination options may be associated with other printer status conditions, such as other print quality modes, use of a secondary media tray, indication of a special media type, etc. It will also be appreciated that additional illumination options may be utilized in a single LED system. For example, a slow blinking LED may indicate a first status condition and a fast blinking LED may indicate a second status condition.

Figures 5, 6:
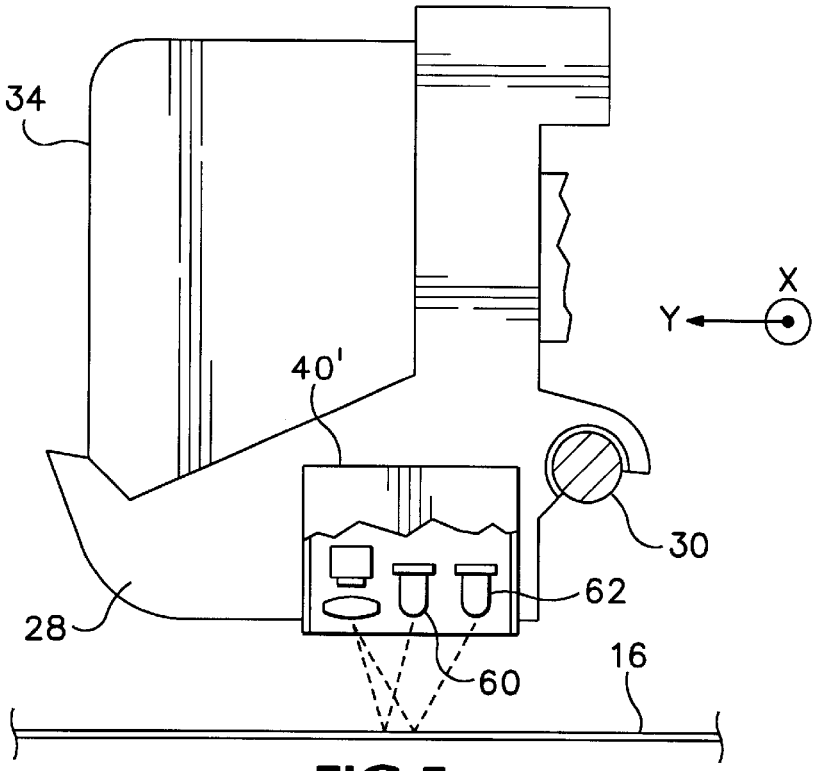
FIG. 5 is a schematic side view of a printhead carriage and an emitter/sensor that includes two LED lamps.
FIG. 6 is a table illustrating different illumination conditions and the corresponding printer status/configuration information as utilized in a two LED embodiment of the present invention.

With reference now to FIG. 5, and in an alternative embodiment of the present invention, the printer 10 may include an emitter/sensor module 40' that comprises two differently-colored LED's 60 and 62 that may be controlled to attract the attention of the user and convey printer status or configuration information. Advantageously, the colors of the two LED's 60, 62 may be chosen so that simultaneous illumination of the two LED's produces a third distinctive color. For example, where the first LED 60 is red and the second LED 62 is blue, their simultaneous illumination will produce violet light.

The table of FIG. 6 illustrates one example of different illumination options and their corresponding printer status indications for a two-lightsource embodiment of the present invention. Continuously illuminating both LED's 60, 62 indicates that a Normal Print Quality mode is being utilized. Simultaneously pulsing or blinking both LED's 60, 62 indicates that two-sided printing is being utilized. Not illuminating both of the LED's 60, 62 during printing indicates that a Draft Print Quality mode is being utilized. Continuously illuminating LED 60 alone indicates that a Best Print Quality mode is being utilized. And continuously illuminating LED 62 alone indicates that a special print media is being used.

It will be appreciated that the illumination options described above may be associated with other printer status conditions, such as use of a secondary media tray, indication of other media types, etc. It will also be appreciated that additional illumination options may be utilized in a dual LED system. For example, a slow blinking LED 60 may indicate a first status condition, a slow blinking LED 62 may indicate a second status condition, a fast blinking LED 60 may indicate a third status condition and a fast blinking LED 62 may indicate a fourth status condition. It will also be appreciated that three or more light sources may be utilized to convey printer status and configuration information to a user. The LED or other light source(s) may be of any color that is sufficiently visible to the user.

In another embodiment of the present invention, one or more light sources that are independent of an optical sensing system may be mounted to the carriage 28 to convey printer status information to a user and to attract the users attention. For example, one or more low cost LED's may be mounted to the carriage 28 and electrically coupled to the printer controller to selectively illuminate and convey printer status information to a user. This type of system may be particularly advantageous for inexpensive printers, where optical sensing systems may be cost prohibitive.

In another advantage of the present invention, the moving light from the reciprocating LED 50 or LED's 60, 62 attracts the user's attention for more effective communication of printer status information. Further, this feature may also appeal to potential customers in a point-of-sale setting, and may help the printer to be perceived as more technically advanced.

Many variations and modifications may be made to the above-described embodiment(s) of the invention without departing substantially from the spirit and principles of the invention. All such modifications and variations are intended to be included herein within the scope of the present invention.

What is claimed is:

1. A method of operating an optical sensor including a light source in a printing apparatus, comprising the steps of:

controlling the light source during a calibration operation to illuminate a receiving medium in the printing apparatus, and to thereby enable the optical sensor to input printer calibration information; and controlling the light source during a printing operation to convey status information related to the printing operation to a user.

2. The method of claim 1, wherein the step of controlling the light source during a printing operation further comprises the step of illuminating the light source while moving the light source.

3. A printing apparatus comprising:

a housing;

a media transport system within the housing and operable to move print media through a print zone;

a carriage movably connected to the housing and movable through the print zone;

a print head mounted to the carriage;

an optical sensor including a light source mounted to the carriage, the light source directed to illuminate the print media in the print zone; and a controller in electrical connection with the optical sensor, the controller comprising:

input logic to control the optical sensor during a calibration operation to illuminate the receiving medium and to input printer calibration information; and output logic to control the optical sensor during a printing operation to convey status information related to the printing operation to a user by illuminating the receiving medium.

* * * * *